United States Patent [19]

Denby

[11] 4,195,939

[45] Apr. 1, 1980

[54] TYPE BAR ACTUATING MECHANISM FOR A TYPEWRITER

[75] Inventor: Robert Denby, Nottingham, England

[73] Assignee: Dobson Park Industries, Ltd., Nottingham, England

[21] Appl. No.: 833,592

[22] Filed: Sep. 15, 1977

[30] Foreign Application Priority Data

Sep. 21, 1976 [GB] United Kingdom ..... 39138/76

[51] Int. Cl.[2] ..... B41J 9/00

[52] U.S. Cl. ..... 400/427; 400/430; 400/434.2; 400/436; 400/440.2; 400/495

[58] Field of Search ..... 400/427, 430, 434.2, 400/436, 440.2, 490, 491, 491.1, 491.2, 495, 495.1

[56] References Cited

U.S. PATENT DOCUMENTS

| | | | |
|---|---|---|---|
| 679,673 | 7/1901 | Hess | 400/434.2 |
| 2,937,736 | 5/1960 | Kuntzel | 400/434.2 |
| 3,108,674 | 10/1963 | Byers | 400/434.2 X |
| 3,338,369 | 8/1967 | Rexford | 400/430 X |
| 3,715,023 | 2/1973 | Jackson et al. | 400/491.2 X |
| 3,787,837 | 1/1974 | Allen et al. | 400/495.1 X |
| 3,962,556 | 6/1976 | Kravchuck | 400/495.1 X |
| 4,000,802 | 1/1977 | Thomson | 400/434.2 |

FOREIGN PATENT DOCUMENTS

| | | | |
|---|---|---|---|
| 830347 | 2/1952 | Fed. Rep. of Germany | 400/427 |

*Primary Examiner*—Ernest T. Wright, Jr.
*Attorney, Agent, or Firm*—Bertram Frank

[57] ABSTRACT

A typewriter of the kind having an array of typebars each movable by means of a flexible tension element or string connecting the typebar to the shank of a corresponding key, is provided with improved means connecting each string to the associated key. The string has a spherical bead at one end which is trapped between the shank of the key and a part of the body of the typewriter against which the shank slides in such a manner that the bead is pushed down on depression of the key. When the key is fitted to the typewriter during assembly the bead is drawn between the shank and the said body part by the movement of the key into place in the typewriter body.

8 Claims, 7 Drawing Figures

TYPE BAR ACTUATING MECHANISM FOR A TYPEWRITER

Figure 1:
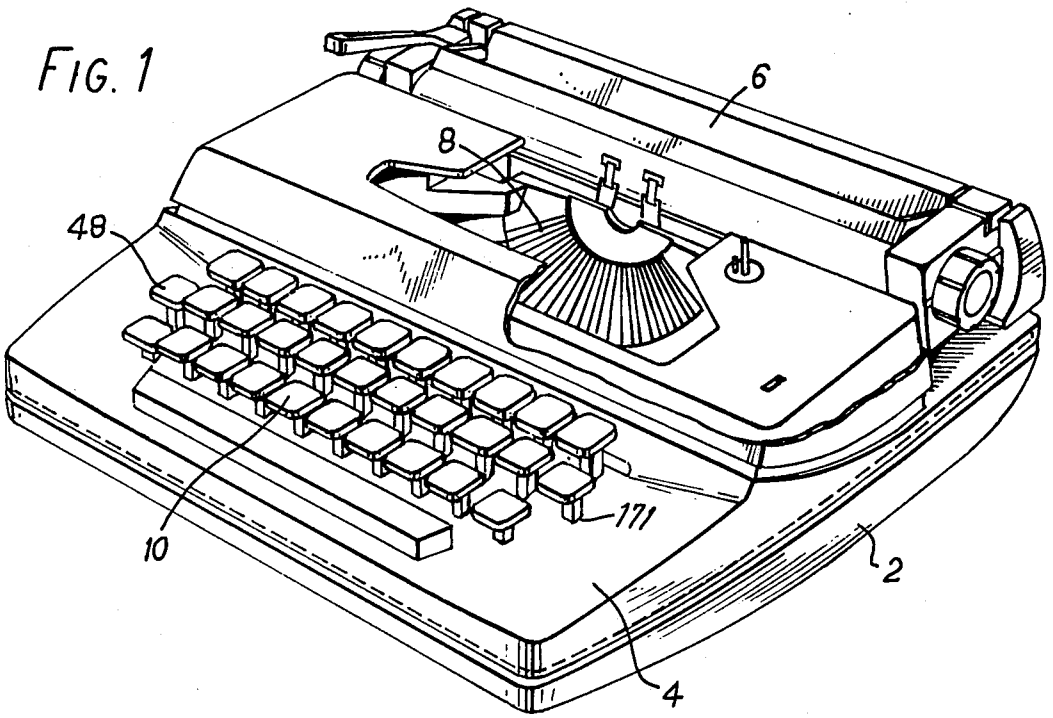

This invention relates to typewriters. More particularly, but not exclusively, the invention relates to toy typewriters.

The invention is concerned particularly with typewriters of the kind having an array of keys each including a shank slidable vertically in a respective bore formed in the body of the typewriter and a corresponding array of type bars each of which is operable by means of a tension element connecting the type bar to the shank of the corresponding key, at least a length of the tension element adjacent the key shank being flexible and being trained over an edge of the bore in which the shank slides so that depression of the key effects longitudinal movement of the tension element to operate the type bar. Such typewriters are referred to hereinafter as typewriters "of the kind set forth".

British Pat. No. 878,185 describes a typewriter of the kind set forth in which each tension element is connected to the associated key by means of a crosspiece formed on the end of the element and engaging in slots formed in the bottom of the key shank. With such a construction it is awkward to attach the elements to the keys during assembly, and there is a danger that the elements may become detached from the keys during use of the typewriter.

It is an object of the invention to provide a typewriter which avoids those disadvantages.

According to this invention there is provided a typewriter of the kind set forth, in which the shank of each key has a vertically extending recess adapted to receive a bead formed on the end of the flexible length of the associated tension element and to accommodate the adjacent portion of the element when the key is depressed, the bead engaging beneath abutment means formed in the recess and shaped to allow the adjacent part of the tension element to extend upwards past the abutment means, and in which the part of the recess housing the bead is closed by an inner face of the bore in which the shank slides so as to retain the bead in the shank.

Preferably, the part of the recess below the abutment means is open at its lower end so that during assembly of the typewriter the shank can be inserted into the bore after the bead of the associated tension element has been placed in position over the mouth of the bore.

The abutment means may comprise two projections extending inwardly from opposite sides of the recess and spaced apart from one another sufficiently to allow the portion of the tension element adjacent the bead to pass between them.

Suitably, the lower part of the shank of each key is in the form of two flexible legs each having on its side face remote from the other leg a detent which on assembly of the typewriter engages snapwise beneath the lower edge of the bore in which the shank slides, to retain the key.

Advantageously, the end of each tension element remote from the bead is formed as a hook shaped to fit over an end portion of the associated type bar, the hook being retained in place by a projection formed on the tension element and spaced from the open end of the hook.

Figure 2:
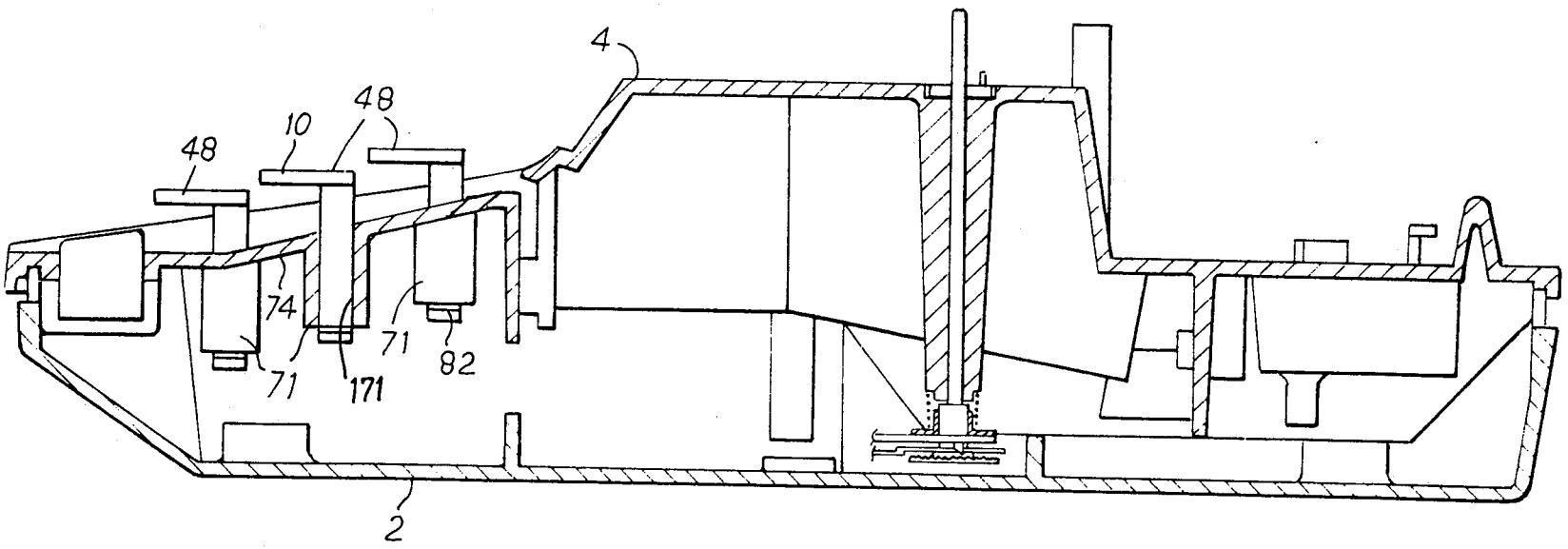
Figure 3:
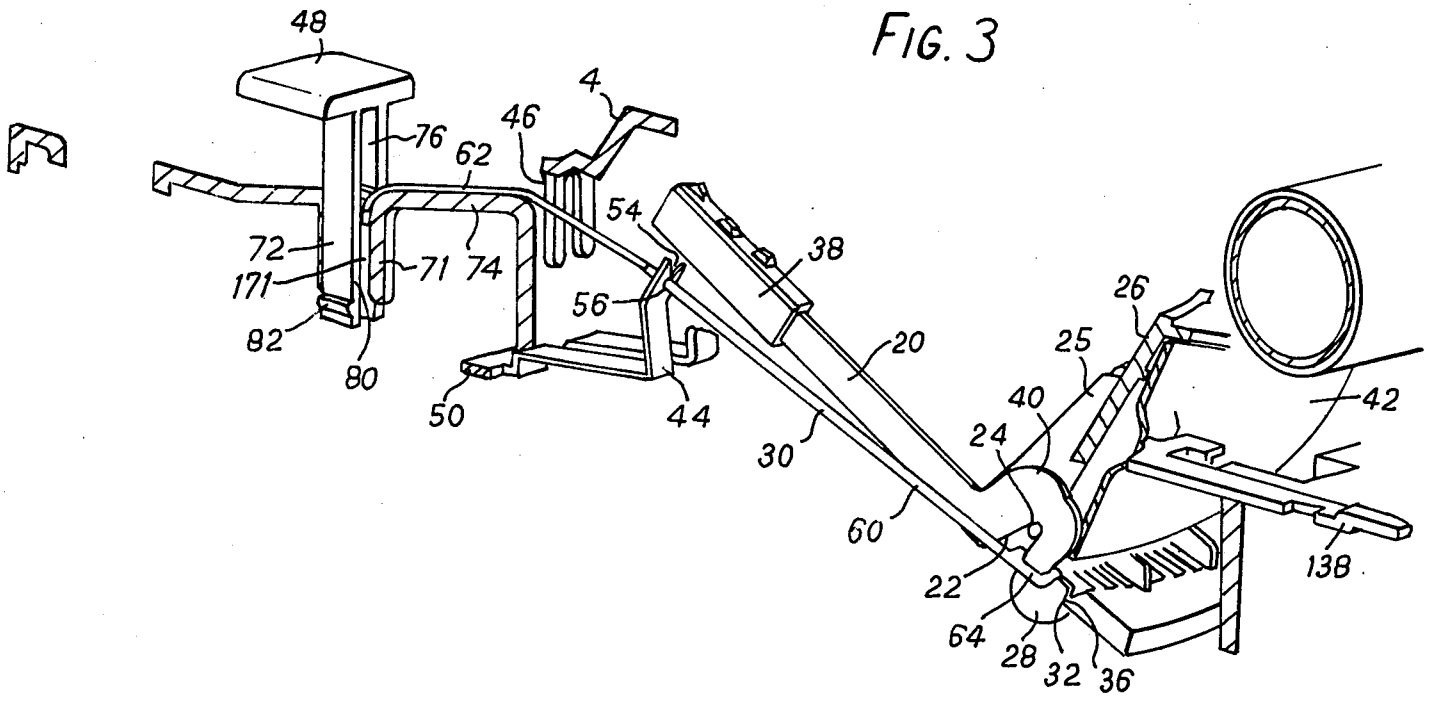
Figure 4:
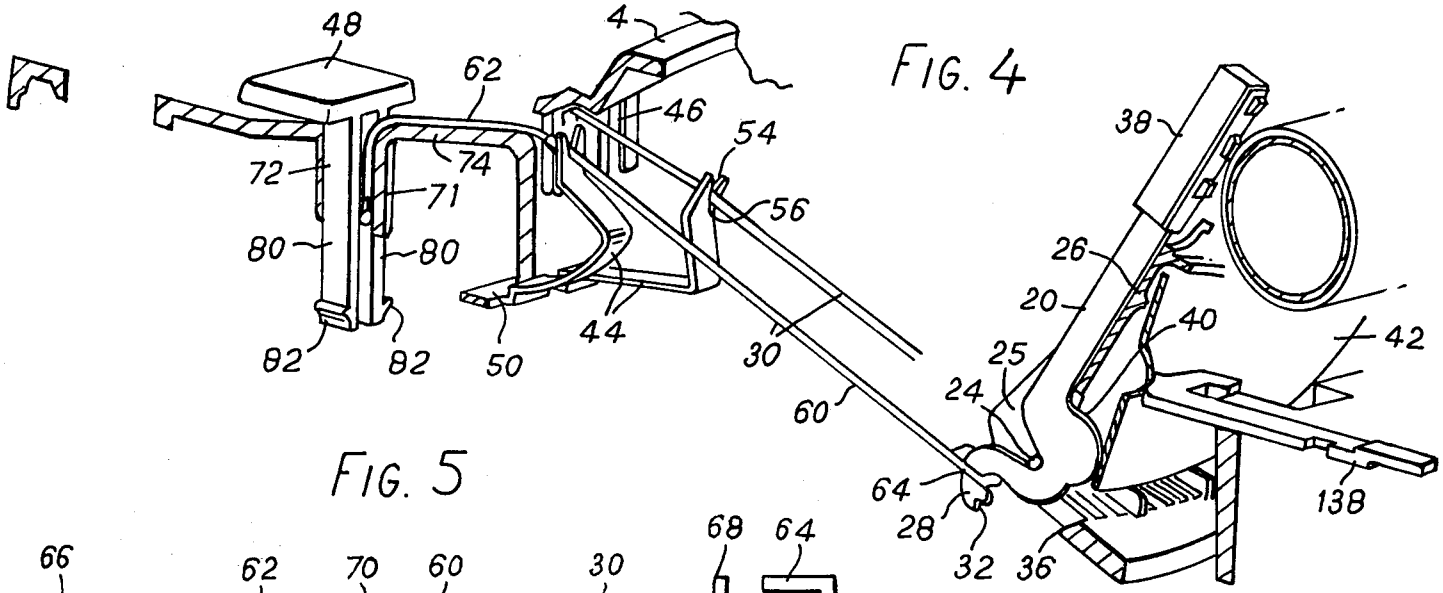
Figure 5:
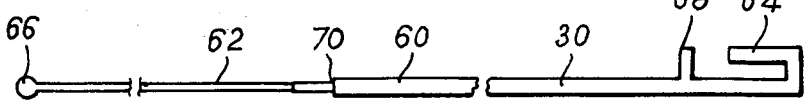
Figure 6:
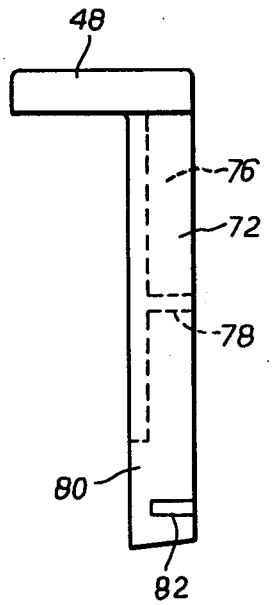
Figure 7:
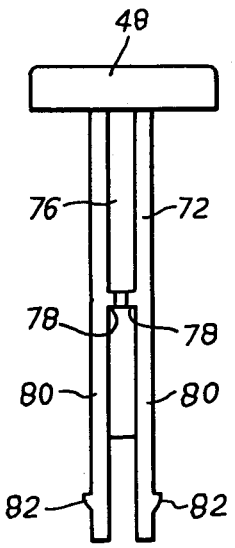

The invention will now be described, by way of example, with reference to the accompanying diagrammatic drawing, in which:

FIG. 1 is a perspective view of a typewriter incorporating the invention,

FIG. 2 is a section through the body of the typewriter, with the carriage and various other mechanisms omitted, FIG. 3 is a fragmentary perspective view, partly in section, showing a key, type bar and associated mechanisms of the typewriter, with the type bar in its rest position, FIG. 4 is a view similar to that of FIG. 3, but showing the type bar in position as the type head strikes the platen, FIG. 5 shows one of the strings connecting each type bar to its associated key, and FIGS. 6 and 7 are, respectively, side and rear elevations of one of the keys of the typewriter.

Referring to the drawing, the typewriter includes a base 2 and a body 4, which support a carriage 6 movable on the body 4, a type bar assembly 8 and a keyboard 10.

The type bar assembly 8 comprises a series of type bars 20 pivotally mounted on a fulcrum 24 formed on a segment 26. Each type bar 20 is shaped at one end to provide a V-shaped recess 22 which can receive the fulcrum 24, which is in the form of a bead moulded integrally with the segment 26, so that the type bar 20 pivots about the fulcrum 24, the type bar 20 moving in and being guided by a slot 25 in the segment 26. At one side of the recess 22 the type bar 20 is shaped to form a hook portion 28 to which is attached one end of an actuating string 30, as described below. The end of the hook portion 28 is formed with a notch 32 which, in the rest position of the type bar 20, engages a stop formed by an edge 36 of the segment 26. The edge 40 of type bar 20 opposite recess 22 forms a cam surface which engages a bail 42 in the form of a flat steel plate. Operation of any of the type bars 20 cause the bail 42 to pivot, as described in published British Pat. No. 859, 835, and to displace an escapement release lever 138 which effects operation of the carriage escapement and associated mechanisms. The mechanisms may take well-known forms, or may be as described in my U.S. Pat. application Ser. No. 833,446 filed on the same date as this application and assigned to the same assignee and are therefore not described further. A type head 38 is moulded onto the other end of each type bar 20, as described in published British Pat. No. 934,402.

The actuating string 30 for each type bar 20 passes through a return spring 44, and a guide slot 46 in the typewriter body 4, to the associated key 48. The spring 44 consists of a strip of plastics extending from and formed integrally with a support moulding 50 which is fixed to the body 4 and which is formed with a similar spring 44 for each string 30. The thinner portion 62 of the string 30 passes through a circular bore 56 in the spring 44, the outer end of the spring 44 having a V-shaped recess 54 leading to the bore 56 so that the string 30 can be inserted snapwise into the bore 56.

Each actuating string 30 is formed from nylon and consists of a thicker portion 60 terminating at one end in a hook portion 64, by means of which the string 30 is connected to the type bar 20, and a thinner portion 62 terminating at the other end of the string 30 in a spherical bead 66. The hook portion 64 engages the hook portion 28 of the type bar 20 and is held in position by a projection 68 on the string 30. The shape of the hook portion 64 of the string 30 facilitates connection of the strings 30 to the type bars 20 during assembly of the typewriter.

The thicker portion 60 of the string 30 is joined to the thinner portion 62 by a step 70 which is engaged by the return spring 44 so that the spring 44 is resiliently deformed when the string 30 is drawn back by key 48 to pivot type bar 20 and acts to return the string 30 and key 48 when the key 48 is released.

The key 48 has a shank 72 slidable vertically in a square cross-section bore 171 in a boss 71 projecting below the upper wall 74 of body 4. The shank 72 has a longitudinally extending recess 76 which can accommodate the bead 66 and adjacent part of the thinner portion 62 of the string 30. A pair of inwardly projecting abutments 78 in the recess 76 define a passage through which the string portion 62 can pass, the bead 66 being engaged beneath the abutments 78 to connect the end of the string 30 to the key 48 so that downward movement of the key 48 is transmitted to the associated type bar 20. The lower end of the shank 72 is in the form of a pair of legs 80 on the outer face of which is formed a detent 82 which engages the lower face of the boss 71 through which the shank 72 slides to limit upward movement of the key 48. Each detent 82 has a bevelled lower face so that, on assembly of the typewriter the shank 72 can be pushed through the bore 171 in the boss 71, the legs 80 being forced together and expanding so that the detents 82 engage snapwise the lower face of the boss 71. During assembly, before the shank 72 is inserted, the bead 66 of the string 30 is positioned over the mouth of the bore 171, so that it becomes disposed within the lower part of the recess 76, and as the key 48 is pushed downwards the bead 66 is carried downwards by engagement with the abutments 78, the adjacent portion 62 of the string 30 moving automatically between the abutments 78 so that the string 30 is properly connected to the key 48. Once the key 48 is inserted, the bead 66 is trapped within the recess 76 by the side of the bore 171 which closes the mouth of the recess 76 and so cannot be inadvertently disconnected. The abutments 78 are positioned so that when the key 48 is fully depressed the bead 66 is not carried beyond the lower end of the boss 71.

The strings 30 are injection moulded from nylon, the thinner portions 62 being drawn to the required length in known manner after moulding whilst the strings 30 remain attached at their other ends to a runner. In assembling the typewriter the strings 30 are initially left connected to the runner, for ease of handling. The thinner portions 62 of the strings 30 are fed through the guide slots 46 and engaged in the bores 56 in springs 44, the lengths of the thinner portions 62 of the strings 30 being such that the bead 66 of each string 30 is positioned over the appropriate bore 171 so that the keys 48 can be inserted as described above. After insertion of the keys 48, each string 30 is detached from its runner and connected to the appropriate type bar 20 as described above.

It will be appreciated that in the described embodiment the attachment of the actuating strings 30 to the keys 48 and typebars 20 is particularly simple, and that the problems set out above are obviated.

I claim:

1. A typewriter having an array of keys each including a shank slidable vertically in a respective bore formed in the body of the typewriter and a corresponding array of type bars each of which is operable by means of a tension element connecting the type bar to the shank of the corresponding key, at least a length of the tension element adjacent the key shank being flexible and being trained over an edge of the bore in which the shank slides so that depression of the key effects longitudinal movement of the tension element to operate the type bar, the shank of each key having an elongated side recess shaped to receive a bead formed on the end of the flexible length of the associated tension element, in which there are provided abutment means in the recess, said abutment means engaging the bead thereby to move the bead on depression of the key, the bead being of a shape and size such that said bead can move within the bore in which the shank slides whilst remaining engaged beneath the abutment means, the length of said bore being such that the bead remains within the bore during full depression of the key, and in which the recess has an opening through which, during assembly of the typewriter, the bead can be inserted into operative alignment in the recess before the shank is inserted into the bore whereby the bead is moved by the shank into its operative position within the bore, and means on said shank cooperating with the lower end of said bore to restrict upward movement of said shank after said bead has been moved to its operative position.

2. A typewriter as claimed in claim 1, in which the recess is a vertically extending recess open at one side, the open side of the recess being closed by an adjacent vertical face of the bore in which the shank slides, thereby to trap the bead in the recess.

3. A typewriter as claimed in claim 2, in which the recess has a portion extending above the abutment means and shaped to accommodate the portion of the tension element adjacent the bead.

4. A typewriter as claimed in claim 3 in which the abutment means comprises two projections extending inwardly from opposite sides of the recess and spaced apart from one another sufficiently to allow the portion of the tension element adjacent the bead to pass between them.

5. A typewriter as claimed in claim 1, in which the part of the recess below the abutment means is open at its lower end so that during assembly of the typewriter the shank can be inserted into the bore after the bead of the associated tension element has been placed in position over the mouth of the bore.

6. A typewriter as claimed in claim 1, in which the lower part of the shank of each key is in the form of two flexible legs each having on its side face remote from the other leg a detent which on assembly of the typewriter engages snapwise beneath the lower edge of the bore in which the shank slides, to retain the key.

7. A typewriter as claimed in claim 1, in which the bead is spherical.

8. A typewriter as claimed in claim 1, in which the end of each tension element remote from the bead is formed as a hook shaped to fit over an end portion of the associated type bar, the hook being retained in place by a projection formed on the tension element and spaced from the open end of the hook.

* * * * *